US010455878B2

(12) United States Patent
Rickle

(10) Patent No.: US 10,455,878 B2
(45) Date of Patent: Oct. 29, 2019

(54) MULTIFUNCTIONAL HOOD SYSTEM FOR HOODED HUNTING GARMENTS

(71) Applicant: Joseph Robert Rickle, Royal Oak, MI (US)

(72) Inventor: Joseph Robert Rickle, Royal Oak, MI (US)

( * ) Notice: Subject to any disclaimer, the term of this patent is extended or adjusted under 35 U.S.C. 154(b) by 133 days.

(21) Appl. No.: 15/841,253

(22) Filed: Dec. 13, 2017

(65) Prior Publication Data

US 2019/0174853 A1 Jun. 13, 2019

(51) Int. Cl.

| | |
|---|---|
| ***A42B 1/04*** | (2006.01) |
| ***F41H 3/00*** | (2006.01) |
| ***A41D 13/00*** | (2006.01) |
| ***A42B 1/00*** | (2006.01) |

(52) U.S. Cl.

CPC ..... *A42B 1/004* (2013.01); *A41D 13/0015* (2013.01); *A42B 1/04* (2013.01); *A42B 1/048* (2013.01); *F41H 3/00* (2013.01)

(58) Field of Classification Search

CPC ..... A42B 1/004; A41D 2200/20; Y10S 2/90; F41H 3/00

USPC ..... D2/825, 758, 831

See application file for complete search history.

(56) References Cited

U.S. PATENT DOCUMENTS

2004/0187186 A1* 9/2004 Boezi ..... A41D 3/00 2/84

2007/0118960 A1* 5/2007 Goodwin ..... A41D 1/04 2/84

2017/0224033 A1* 8/2017 Latta, Jr. ..... A41D 15/04

OTHER PUBLICATIONS

Denso Over Sized Hooded TOP; https://www.amazon.co.uk/Kenzo-Sized-Hooded-Detail-5SW414/dp/B07J9LYK6X/ref=sr_1_fkmr2_2?keywords=kenzo+oversized+hooded+top&qid=1561400156&s=gateway&sr=8-2-fkmr2; accessed Jun. 24, 2019; published Jul. 2012. (Year: 2012).*

FullSource; Camouflage Pullover Hooded Sweatshirt: https://www.fullsource.com/code-v-b22038303/; accssed Jun. 6, 2019; pusblished Jul. 2017. (Year: 2017).*

SAMMYdress; https://www.sammydress.conn/product2294672.html; accessed Jun. 6, 2019; published Jan. 2016. (Year: 2016).*

* cited by examiner

*Primary Examiner* — Daniel J Colilla

(57) ABSTRACT

A system of hoods built into hooded hunting garments, which makes the hunting garment multifunctional for concealment, or for high visibility safety. The hood system consists of an outer hood that is drab or camouflage, matching the garment itself, for the purpose of concealment, and an inner hood that is blaze color or blaze camouflage, for the purpose of high visibility safety. The hunter can quickly, easily, and quietly alternate on demand in the field, between functions of concealment or safety by selecting how the hoods are worn and exposed, without having to remove the entire garment from the body, or detach/reattach components, to do so. The hoods and garment's functions can be altered with one hand, and without removing hand coverings. The system of hoods creates a single multifunctional hunting garment that replaces the need for two distinct garments for specific hunting applications.

11 Claims, 2 Drawing Sheets

MULTIFUNCTIONAL HOOD SYSTEM FOR HOODED HUNTING GARMENTS

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

BACKGROUND OF THE INVENTION

Garments worn for hunting typically consist of drab colors or camouflage patterns that blend in with the hunter's surroundings, such that the hunter is concealed from their prey. Drab or camouflage garments are usually worn for turkey hunting or during archery season for larger game, like deer. Conversely, some hunting garments are highly visible "blaze" or "hunter" orange in color, such that the hunter is contrasted from their surroundings, thereby visually alerting other hunters of their presence for safety. Blaze or hunter orange garments are usually worn during firearm seasons, or as required by State hunting agencies. (Note, the State of Michigan now allows "blaze pink" or "hunter pink" as an optional safety color for its firearm seasons.) Then there are "reversible" hunting garments, where one garment can be altered in appearance for both concealment and high visible safety. My invention of a multifunctional hood system for hooded hunting garments pertains to this field of reversible hunting garments.

Reversible hunting garments are typically two-sides of contrasting colors/patterns. The problem is the garment has to be inverted off the body to expose the applicable function of concealment or high visibility safety. This inversion is fine as long as the hunter plans on staying in that function for the entire hunting event. But there are situations in the field when the hunter wants to alternate between concealment and high visibility safety. For example, the hunter wants to be highly visible for safety while walking to and from their stationary hunting position. Upon arrival, the hunter wants to alternate to being concealed for the hunt. It wouldn't be practical for the hunter to remove the garment, invert it, and put it back on, especially during cold and wet weather conditions. Other examples of when a hunter wants to alternate from concealment to high visibility safety are while tracking their prey, field dressing it, and removing the prey from the field. Additionally, if another hunter walks upon their concealed position, the hunter wants to temporarily switch to high visibility safety to alert the other hunter of their presence, without audibly calling out, and then switch back to concealment. It would take too long, and again wouldn't be practical, to remove the garment, invert it, reinstall it, and then do it all again to return to the original function. My invention is a multifunctional hood system for hooded hunting garments that allows the hunter to alternate between functions of concealment and high visibility safety without having to remove the entire garment from their body to do so. Only the orientation and exposure of the hoods are alternated.

Other reversible hunting garments rely on removable components of contrasting colors/patterns to alternate function. These components can be forgotten, misplaced, or lost. The removable components require special fasteners like zippers, snaps, buttons, hook and pile devices, and pockets. These fasteners are subject to breaking and wearing out. Hook and pile fasters are loud. Special fasteners and pockets are difficult to employ while wearing gloves, or with one hand, requiring gloves to be removed and hunting gear to be set down. My invention of a multifunctional hood system is permanently and integrally built into the hunting garment such the hoods cannot be forgotten, misplaced, or lost. Alternating the hoods and functions do not rely on special fasteners. The inner hood fits inside the outer hood, and they don't rely on pockets when alternating functions. The hoods can be switched quietly, while wearing gloves, and with one hand.

BRIEF SUMMARY OF THE INVENTION

The invention is a system of hoods built into hooded hunting garments, where the hoods themselves make the garment multifunctional for either concealed hunting or high visibility safety. The hood system consists of two hoods that fit together and are integrally sewn into the collar of the garment, requiring no special fasteners or pockets. The outer hood is for purposes of concealment and is drab in color or camouflage pattern, and matches the garment itself. The inner hood is for purposes of high visibility safety and is blaze orange, blaze orange camouflage, blaze pink, or blaze pink camouflage. The hunter is able to alternate between concealment and high visibility safety by simply selecting how the hoods are worn and exposed.

Prior art reversible hunting garments either require the entire hunting garment to be off the body to be inverted, or rely on detachable components with special fasteners and pockets to be reversed and reinstalled. The multifunctional hood system, however, allows the hunter to alternate functions by changing the orientation of the integral hoods only, therefore the entire garment does not have to be removed from the body to do so. This distinction allows the concealed hunter to alternate functions on demand in the field when it is advantageous to be highly visible, such as traveling to and from the stationary hunting location, temporarily alerting others of their presence, and tracking and field dressing their prey, without the inconvenience of removing the entire garment to invert it, especially in cold and wet weather conditions. The hoods are permanently built in, therefore they cannot be forgotten, misplaced, or lost like prior art detachable components. There are no special fasteners required to alternate the garment's functions. Special fasteners are subject to damage and wearing out, and require gloves to be removed or gear to be set down in order to employ. The systems of hoods are alternated quietly, quickly, and easily, while wearing gloves, or with one hand such that gear does not have to be set down. The inner hood fits inside the outer hood, and they don't rely on pockets while alternating functions.

BRIEF DESCRIPTION OF DRAWINGS

Sheet 1/2 contains FIG. 1, a perspective view of the multifunctional hood system built into a hooded hunting garment. In this case, the hunting garment is shown as a hooded sweatshirt, for example, but could be a hooded jacket, hooded coat, hooded rain coat, or any other hunting garment that incorporates a hood. This view depicts the components of the hood system, and its relationship to the hooded hunting garment in which it is built into. The dark shading of the outer hood and garment represents drab color or camouflage pattern, whereas the unshaded inner hood represents the contrasting blaze orange, blaze orange camouflage, blaze pink, or blaze pink camouflage.

Sheet 2/2 contains FIG. 2, FIG. 3, FIG. 4, and FIG. 5, all of which are elevations or side views of the invention, depicting the different multifunctional modes in which the invention is used and worn.

Figure 2:
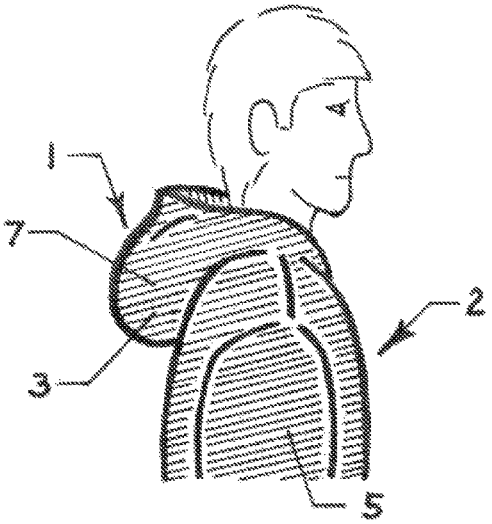

FIG. 2 depicts the concealment function when the hunter chooses to not wear a hood over their head.

Figure 3:
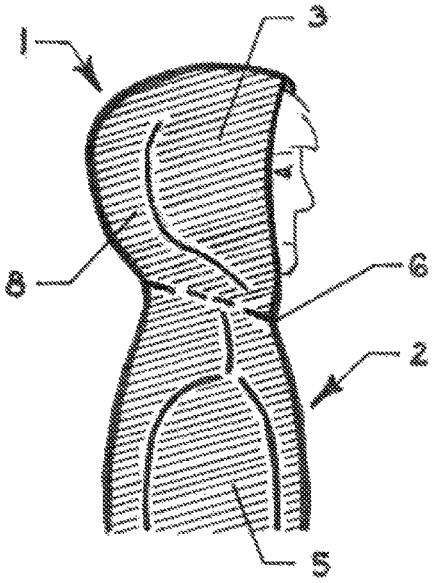

FIG. 3 depicts the concealment function when the hunter chooses to wear a hood over their head.

Figure 4:
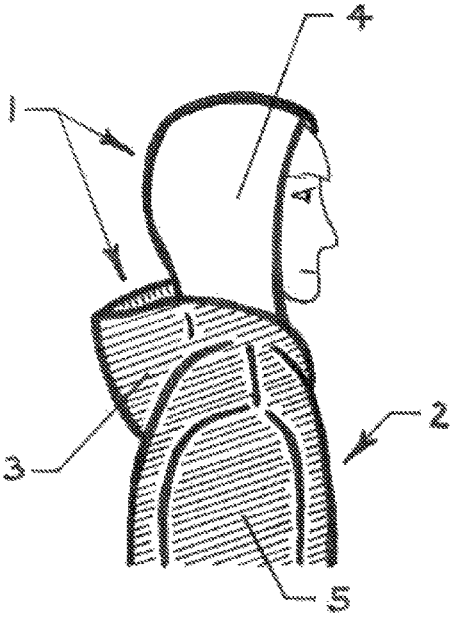

FIG. 4 depicts the high visibility safety function when the hunter chooses to wear a hood over their head.

Figure 5:
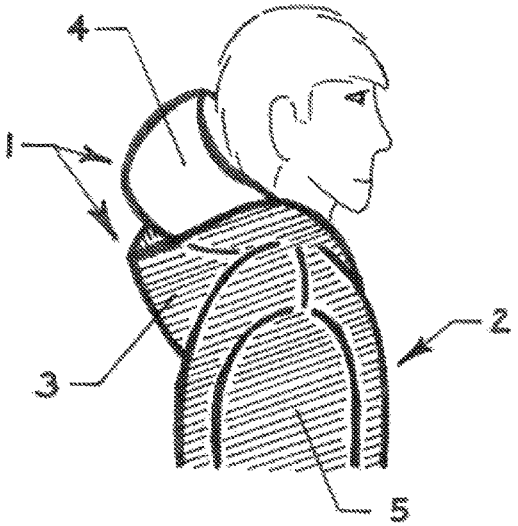

FIG. 5 depicts the high visibility safety function when the hunter chooses to not wear a hood over their head. In all of the views on this sheet, the hunting garment is again shown as a hooded sweatshirt, for example. The dark shading of the outer hood and garment represents drab color or camouflage pattern, whereas the unshaded inner hood represents the contrasting blaze orange, blaze orange camouflage, blaze pink, or blaze pink camouflage.

DETAILED DESCRIPTION OF THE INVENTION

My invention is a system of hoods (Reference 1 of FIGS. 1, 2, 3, 4, and 5) built into hooded hunting garments (Reference 2 of FIGS. 1, 2, 3, 4, and 5), where this system of hoods makes the hunting garment multifunctional for purposes of concealment, or for high visibility safety (FIGS. 2, 3, 4, and 5). Instead of one built-in hood, the hooded hunting garment consists of two hoods of contrasting colors/patterns (References 3 and 4 of FIGS. 1, 4, and 5). The outer hood is for the purpose of concealment, being drab color or camouflage pattern (Reference 3 of FIGS. 1, 2, 3, 4, and 5), and matching the color/pattern and material of the hunting garment itself (Reference 5 of FIGS. 1, 2, 3, 4, and 5). The inner hood is for the purpose of high visibility safety, being blaze orange, blaze orange camouflage, blaze pink, or blaze pink camouflage (Reference 4 of FIGS. 1, 4, and 5). The hunter can quickly and easily alternate between functions of concealment or high visibility safety by selecting how the hoods are worn and exposed, without having to remove the entire garment from the body, or detach/reattach components, to do so (FIGS. 2, 3, 4, and 5).

Figure 1:
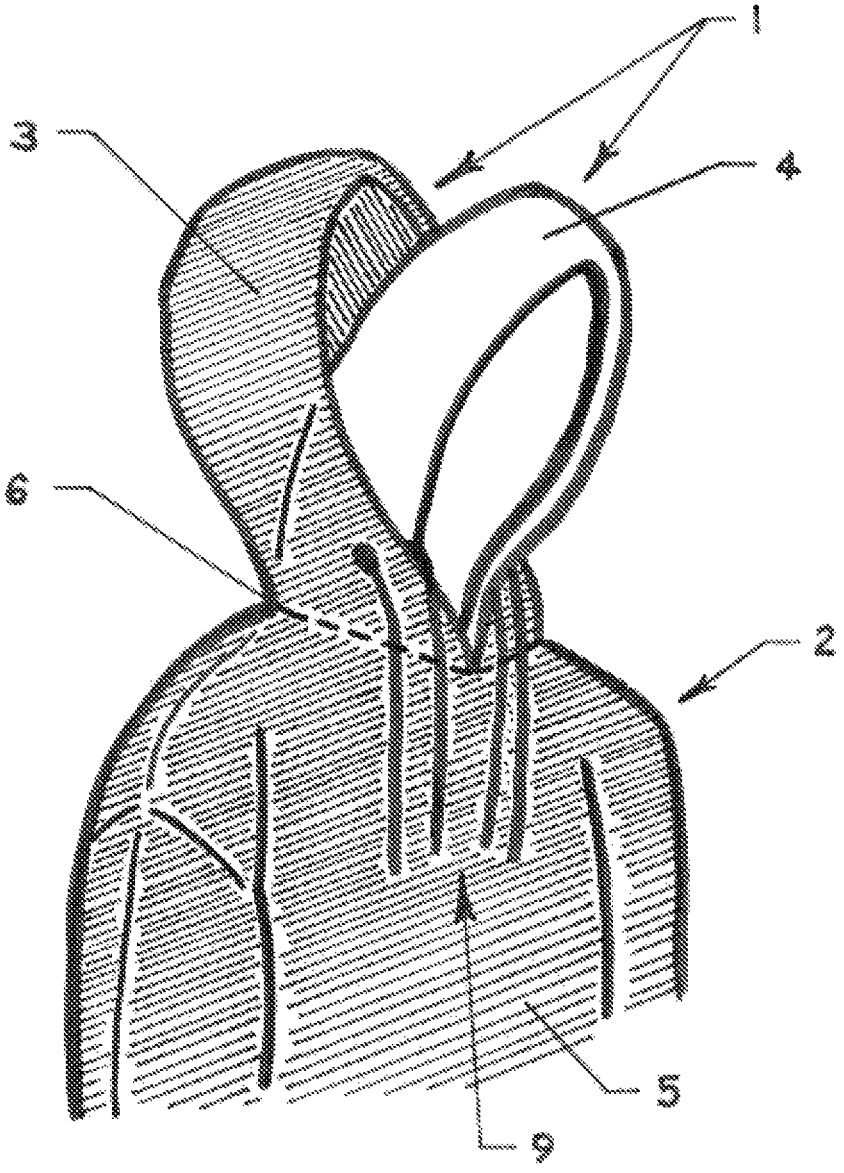
FIG. 1 is the suggested front page view of the patent application publication and patent.

Both hoods of the hood system are integrally and permanently sewn together at their bases and into the collar of the garment, consistent with single hooded garments, requiring no special fasteners or attachments (Reference 6 of FIGS. 1 and 3). The inner hood's size is proportionate with the size of the garment, while the outer hood is one size larger, such that the inner blaze hood fits inside the outer drab/camouflage hood and out of view, requiring no pockets or devices to store the inner hood (References 7 and 8 of FIGS. 2 and 3). Both hoods have their own independent drawstring to tighten the hood around the perimeter of the face, but both drawstrings are drab color or camouflage pattern since the system of hoods does not rely on the drawstrings' color/pattern or function for its multifunctional purposes (Reference 9 of FIG. 1). The drawstrings are not shown in FIGS. 2, 3, 4, and 5 for purposes of clarity.

When the garment is worn for purposes of concealment, and the hunter chooses to not wear a hood over their head, the inner blaze hood is out of view, lying inside the outer drab/camouflage hood, and both hoods lie around the neck and back of the hunter (Reference 7 of FIG. 2). When the hunter choses to employ a hood, the outer drab/camouflage hood is pulled over the head, while the inner blaze hood remains out of view, lying tucked inside and around the neck and back of the hunter (Reference 8 of FIG. 3).

When the garment is worn for purposes of high visibility safety, the inner blaze hood is worn over the hunter's head (Reference 4 of FIG. 4), therefore its high visibility color is exposed, while the outer drab/camouflage hood lies around the neck and back of the hunter (Reference 3 of FIG. 4). When the hunter chooses to not wear a hood over their head, the inner blaze hood is pulled off of the head but not tucked into the outer drab/camouflage hood, therefore maintaining its high visibility exposure (References 3 and 4 of FIG. 5).

The system of hoods replaces the need for two separate and specific hunting garments, typical of reversible hunting garments. The entire garment itself, however, does not need to be removed from the body to be reversed. Only the orientation of the hoods need to be switched (FIGS. 2, 3, 4, and 5). This distinction provides an on-demand function, allowing the hunter to quickly and easily alternate between concealment and high visibility safety in the field, and is advantageous in several applications for concealed hunting. When the hunter is walking to and from their hunting position, for example, they would wear or expose the inner blaze hood to be safely visible to other hunters in the area (FIG. 4 or 5), but then cover the inner blaze hood with the outer drab/camouflage hood to be concealed once stationary (FIG. 2 or 3). If another hunter walks upon their concealed position, the hunter would temporality switch back to the inner blaze hood being exposed, so as to alert the other hunter of their presence, without having to audibly call out (FIG. 4 or 5). Another application is after the hunter engages their prey. The hunter would switch to exposing the inner blaze hood to be safely visible to other hunters while tracking, field dressing, and removing their prey from the field (FIG. 4 or 5). If a hunter should become lost in the field, they would expose the inner blaze hood to be highly visible until found (FIG. 4 or 5). It wouldn't be practical in these applications to remove a typical reversible garment, invert it, and then put it back on in blaze mode, only to have to remove it again, invert it, and put it back on in concealed mode, especially during cold and wet weather conditions.

Other reversible hunting garments rely on detachable components to be reversed and reinstalled, requiring special fasteners and pockets. These components can be forgotten, misplaced, or lost. The special fasteners can be damaged or worn out. Hook and pile fasteners are loud. The system of hoods, however, are permanently sewn in and integral with the garment, therefore eliminating their loss (Reference 6 of FIGS. 1 and 3). The hunter does not need to fumble around with special fasteners or pockets to employ or store the hoods, which is difficult while wearing gloves, or requires both hands and gear to be set down. The system of hoods are alternated quietly, quickly, and easily. Gloves do not have to be removed to alternate the hoods, and can be done with one hand such that hunting gear does not have to be set down.

A side benefit of the multifunctional hood system is the second hood material provides additional warmth and weather protection around the neck and back of the hunter, in all modes of wear (FIGS. 2, 3, 4, and 5). In extreme cold, both hoods could be worn over the head to provide additional warmth, but only for concealment, since the outer drab/camouflage hood would cover the inner blaze hood.

The invention I claim is:

1. A multifunctional hood system built into a hooded hunting garment, comprising of two hoods, each with an independent drab color or camouflage pattern drawstring, where an outer hood is drab color or camouflage pattern, matching the garment in appearance and material, for the function of concealment from a hunter's prey, while an inner hood is blaze orange, blaze orange camouflage, blaze pink, or blaze pink camouflage, for the function of high visibility safety, allowing a hunter to readily alternate, on demand, between said functions of concealment or safety in the field by selecting how the said hoods are worn or exposed, without having to remove the entire garment from their body, or detach/reattach components, to do so.

2. The multifunctional hood system according to claim 1, in which both said hoods are sewn into a collar of the garment, the said inner hood fitting out of view inside the said outer hood, making an integral hooded garment such that said hoods are permanently connected, cannot be forgotten, misplaced or lost, do not need to be stored, or do not require special fasteners or pockets to alternate between said functions of said hoods.

3. The multifunctional hood system according to claim 1, where each said independent drab or camouflage drawstring is to tighten the said hood around the perimeter of the hunter's face.

4. The multifunctional hood system according to claim 1, such that when the garment is worn for concealment, the said outer drab/camouflage hood is worn over or off the head, while the said inner blaze hood lies out of view inside the said outer hood, tucked around the neck and back of the hunter.

5. The multifunctional hood system according to claim 1, such that when the garment is worn for high visibility safety, the said inner blaze hood is worn over or off the head, not tucked into the said outer drab/camouflage hood which lies around the neck and back of the hunter.

6. The multifunctional hood system according to claim 1, in which the said garment being singular, replaces the need for two distinct, separate garments specific to either concealed hunting, or high visibility safety hunting.

7. The multifunctional hood system according to claim 1, where alternating between said functions of concealment or high visibility safety, by hood orientation, is capable with one hand such that gear does not have to be set down.

8. The multifunctional hood system according to claim 1, where alternating between said functions of concealment or high visibility safety, by hood orientation, is capable without needing to remove hand coverings like gloves or mittens.

9. The multifunctional hood system according to claim 1, where alternating between said functions of concealment or high visibility safety, by hood orientation, is capable of being done quietly.

10. The multifunctional hood system according to claim 1, in which the second said hood material provides additional warmth and weather protection around the neck and back of the hunter, in all modes of wear.

11. The multifunctional hood system according to claim 1, such that when the garment is worn for concealment, both said hoods are worn over the head at the same time, for additional warmth and weather protection around the head of the hunter.

* * * * *